US005996687A

United States Patent [19]

Pringle et al.

[11] Patent Number: 5,996,687

[45] Date of Patent: Dec. 7, 1999

[54] FULL BORE VARIABLE FLOW CONTROL DEVICE

[75] Inventors: Ronald E. Pringle, Houston; Arthur J. Morris, Magnolia, both of Tex.

[73] Assignee: Camco International, Inc., Houston, Tex.

[21] Appl. No.: 09/100,656

[22] Filed: Jun. 19, 1998

Related U.S. Application Data

[60] Provisional application No. 60/053,620, Jul. 24, 1997.

[51] Int. Cl.[6] ..... E21B 34/16

[52] U.S. Cl. ..... 166/66.6; 166/324; 166/330; 137/599.2; 137/614.17; 251/117

[58] Field of Search ..... 166/66.6, 66.7, 166/319, 320, 324, 330; 137/599.2, 614.17; 251/117

[56] References Cited

U.S. PATENT DOCUMENTS

| | | | |
|---|---|---|---|
| 3,233,677 | 2/1966 | Myers | 166/330 |
| 3,418,397 | 12/1968 | Baker | 166/320 |
| 4,415,036 | 11/1983 | Carmody et al. | 166/324 |
| 4,452,311 | 6/1984 | Speegle et al. | 166/324 |
| 4,478,286 | 10/1984 | Fineberg | 166/324 |
| 4,641,707 | 2/1987 | Akkerman | 166/324 |
| 5,207,272 | 5/1993 | Pringle et al. | 166/66.6 |
| 5,211,241 | 5/1993 | Mashaw | 166/332 |
| 5,309,988 | 5/1994 | Shy | 166/72 |
| 5,355,953 | 10/1994 | Shy | 166/250 |
| 5,503,229 | 4/1996 | Hill, Jr. et al. | 166/324 |
| 5,794,699 | 8/1998 | Hammett | 166/332.2 |
| 5,803,167 | 9/1998 | Bussear | 166/65.1 |
| 5,803,178 | 9/1998 | Cain | 166/306 |

FOREIGN PATENT DOCUMENTS

| | | |
|---|---|---|
| 0604135B1 | 6/1994 | European Pat. Off. . |
| 0861968A2 | 9/1998 | European Pat. Off. . |

*Primary Examiner*—Hoang C. Dang
*Attorney, Agent, or Firm*—Arnold White & Durkee

[57] ABSTRACT

A variable flow control device having a substantially cylindrical housing with a valve element connected to an inner surface thereof. The valve is movable between an open position and a closed position in the bore. One or more flow control orifices are located in the valve element for controlling the flow of fluids through the housing when the valve element is in the closed position. A drive mechanism is also connected to the valve element for controlling the size of the one or more flow control orifices. As such, a full bore variable flow control device is provided that controls the flow of wellbore fluids without permanent reduction of the internal bore of the production tubing. By closing the flapper valve and selecting the size of the variable orifices, total control of the production flow of the wellbore can be achieved. By opening the flapper valve, full bore wireline operations to the bottom of the well can be performed.

14 Claims, 7 Drawing Sheets

FULL BORE VARIABLE FLOW CONTROL DEVICE

This application claims benefit of U.S. provisional application 60/053,620, filed on Jul. 24, 1997.

BACKGROUND OF THE INVENTION

The present invention relates to a device for controlling the flow of fluids through a well bore, and more specifically to a flow control device that allows for both controlled flow and full bore flow of well bore fluids.

Downhole control of production fluids is sometimes necessary and desirable. Conventional means of controlling the flow of production fluids has required reduction of the internal bore of the production tubing. This reduced bore prevents wireline operations, such as temperature and pressure surveys, to the bottom of the well. Thus, there is a need for a flow control device that will permit both full bore flow of fluids and the passage of wireline tools to the bottom of the well.

SUMMARY OF THE INVENTION

The present invention provides a full bore variable flow control device that controls the flow of wellbore fluids without permanent reduction of the internal bore of the production tubing. By closing a valve element with a variable orifice in the flow stream, total control of the production flow of the wellbore can be achieved. By opening the valve element, full bore wireline operations to the bottom of the well can be performed.

According to one aspect of the present invention the variable flow control device comprises a housing having a bore therethrough and a valve element connected to the housing and movable between an open position and a closed position in the bore. One or more flow control orifices are located in the valve element for controlling the flow of fluids through the housing when the valve element is in the closed position. A drive mechanism is also connected to the valve element for controlling the size of the one or more flow control orifices. The housing is adapted to be connected at each end thereof to well tubing. A valve seat element may also be provided for receiving the valve element in the closed position.

The variable flow control device may further include means for sensing the flow rate of fluid through the bore of the variable flow control device. The flow rate sensing means may take the form of first and second pressure transducer sensors positioned on the inner wall of the housing on opposite sides of the valve element, and a multiplexor for receiving signals from each sensor and translating the signals into a flow rate signal. Alternatively, the flow rate sensing means may take the form of fiber optic lines connected to the transducer sensors.

The valve element of the variable flow control device may include a main body member and an orifice plate rotatable in relation to the main body member. One or more flow control orifices may formed in the orifice plate and one or more corresponding flow control orifices may formed in the main body member. A drive mechanism may be provided for imparting rotary motion to the orifice plate. The drive mechanism preferably includes a gear engaging the outer circumferential surface of the orifice plate to impart rotary motion thereto, a drive shaft coupled to the gear, and a motor coupled to the drive shaft for imparting rotary motion to the gear.

The variable flow control device may further include a flow tube longitudinally movable in the housing for causing the opening and closing of the valve element. Spring means may also be positioned between the housing and the flow tube for moving the flow tube in a direction to open the valve element. A hydraulic piston and cylinder assembly may be provided and is preferably located in the housing. The piston is preferably connected to the flow tube for moving the flow tube in a direction to close the valve element.

According to another aspect of the invention, a variable flow control device including a housing having a bore therethrough and adapted to be connected at each end thereof to well tubing, a valve element connected to the housing and movable between an open position and a closed position in the bore, and means for controlling the flow of fluids through the housing when the valve element is in the closed position is provided. A means for sensing the flow rate of fluid through the bore of the variable flow control device may be provided. Means for opening and closing the valve element may also be provided.

Other and further objects, features and advantages will be apparent from the following description of a presently preferred embodiment of the invention, given for the purpose of disclosure and taken in conjunction with the accompanying drawings.

DESCRIPTION OF ILLUSTRATIVE EMBODIMENTS

Figure 1:
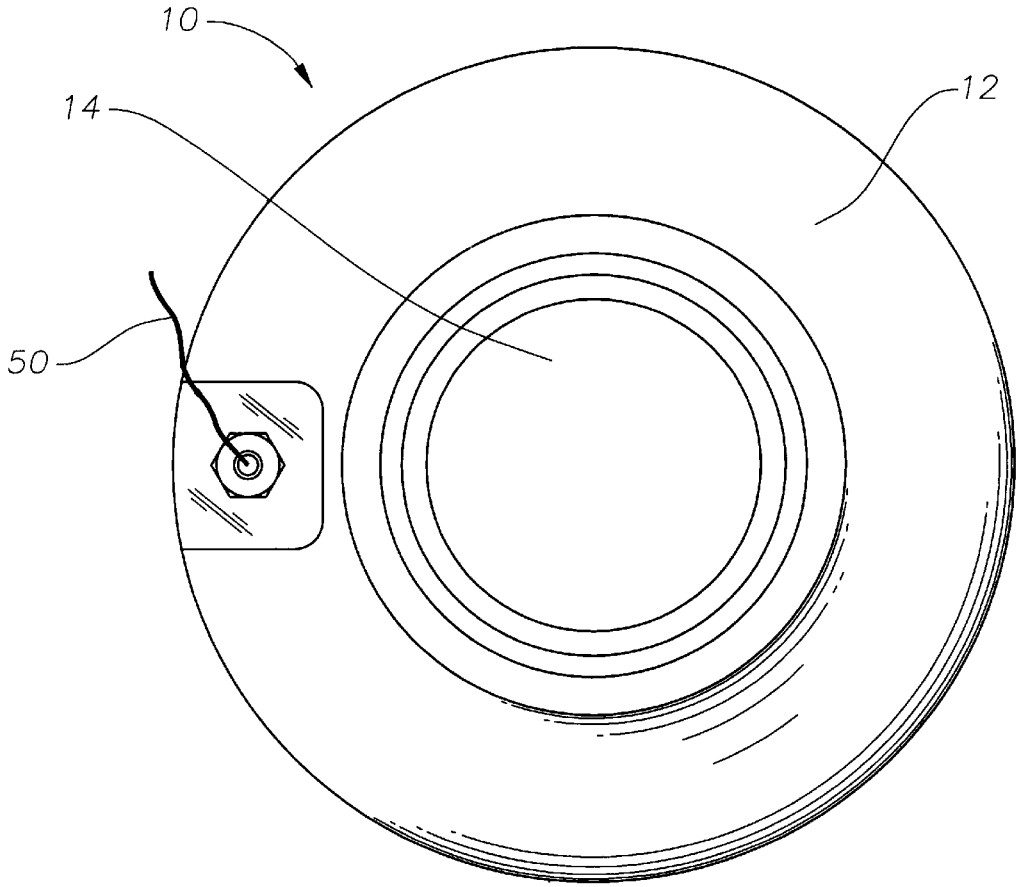
FIG. 1 shows a top plan view of a full bore variable flow control device according to an embodiment of the present invention.

Referring now to the drawings, and particularly to FIGS. 2A, 2B, 2C, 2D and 2E, a full bore variable flow control device 10 is shown having a substantially cylindrical body 12 having an open bore 14 therethrough for allowing the flow of product, such as oil and gas. Various wire-line tools may also pass through the bore 14 to perform a variety of necessary functions to maintain production of the well. The full bore variable flow control device 10 may be connected to a string of tubing (not shown) by connectors 16, 18 at each end thereof.

Figure 2A:
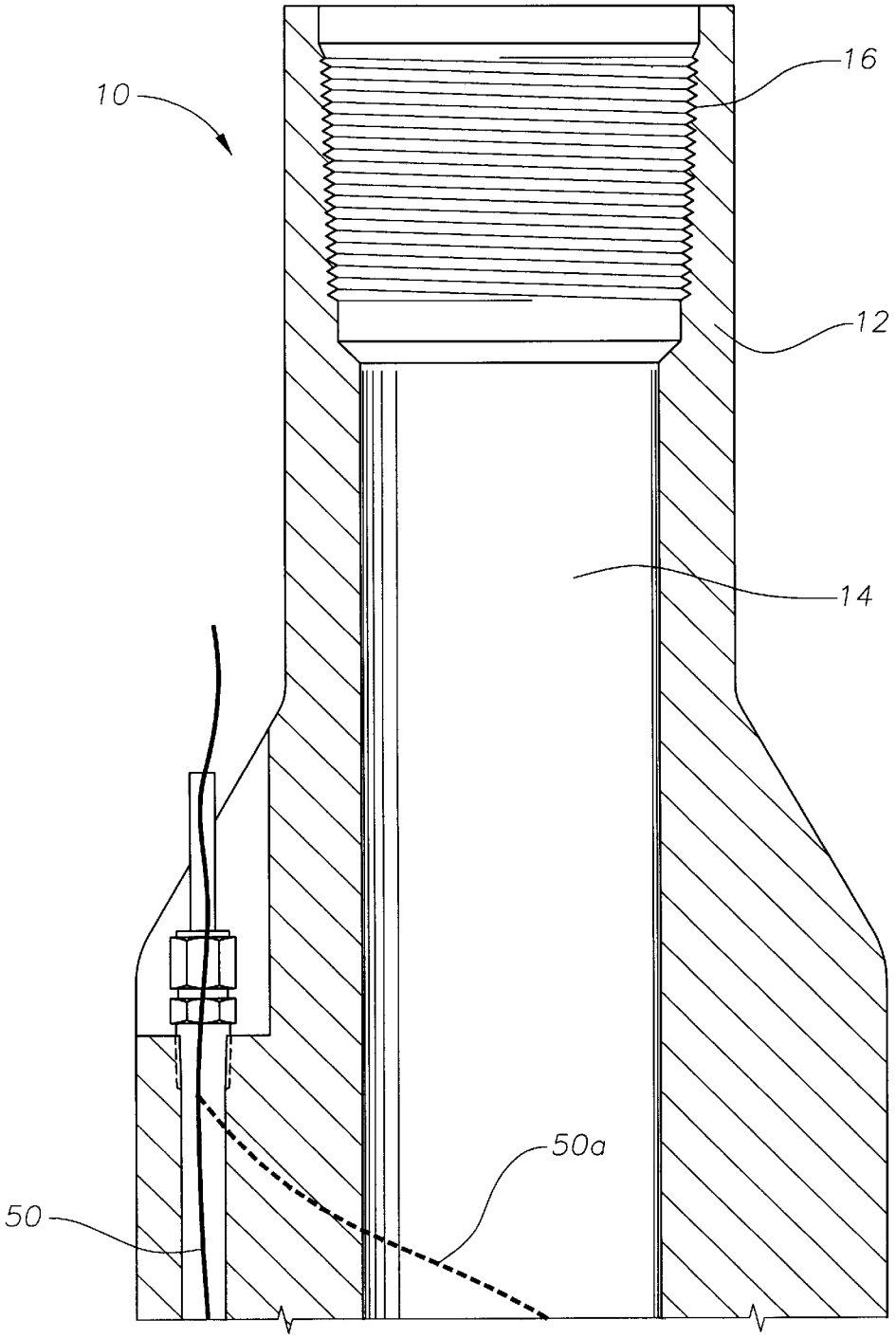
FIGS. 2A, 2B, 2C, 2D and 2E are continuations of each other and form an elevational view, in cross section, of the full bore variable flow control device shown in FIG. 1.
Figure 2B:
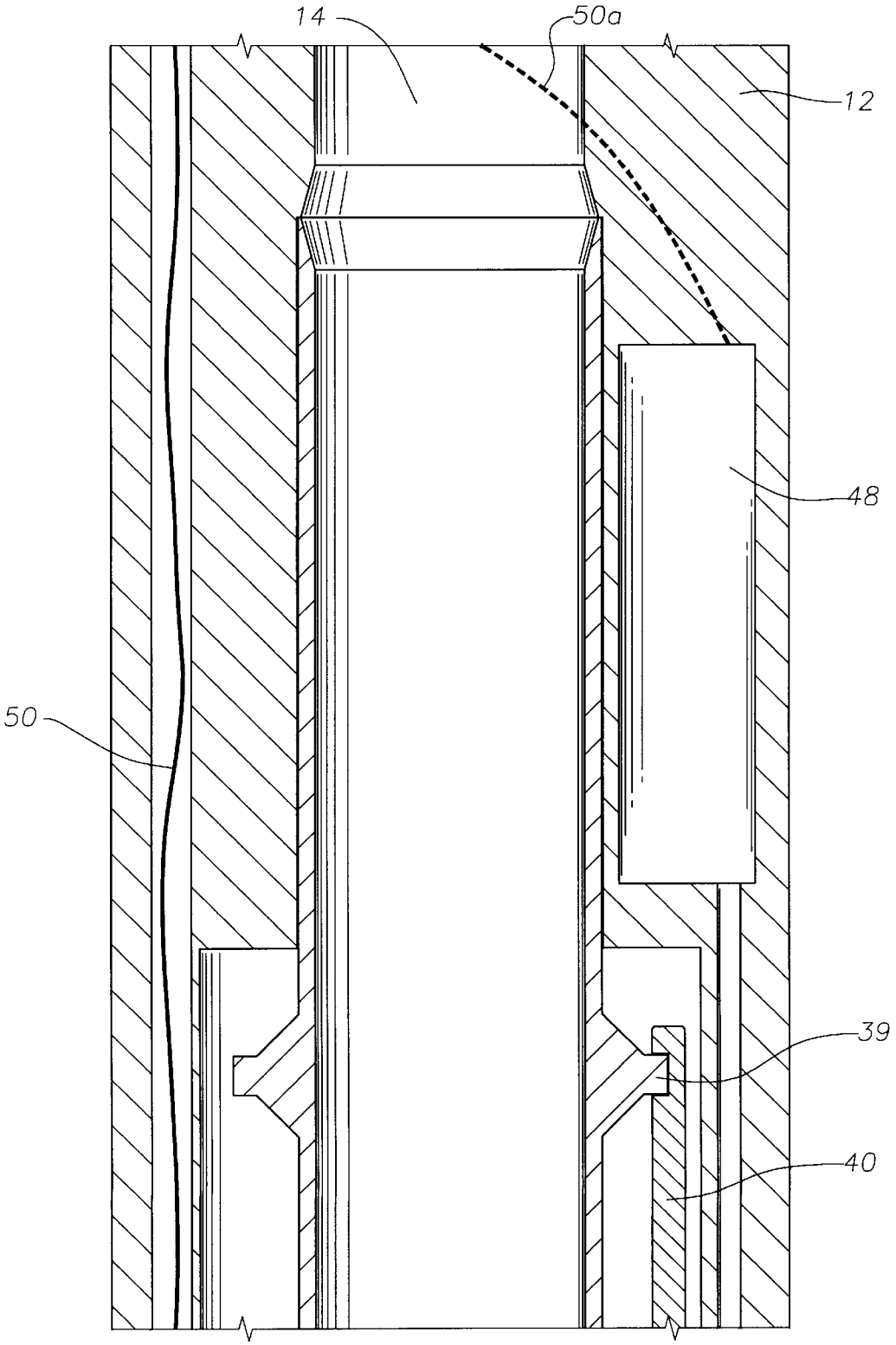
Figure 2C:
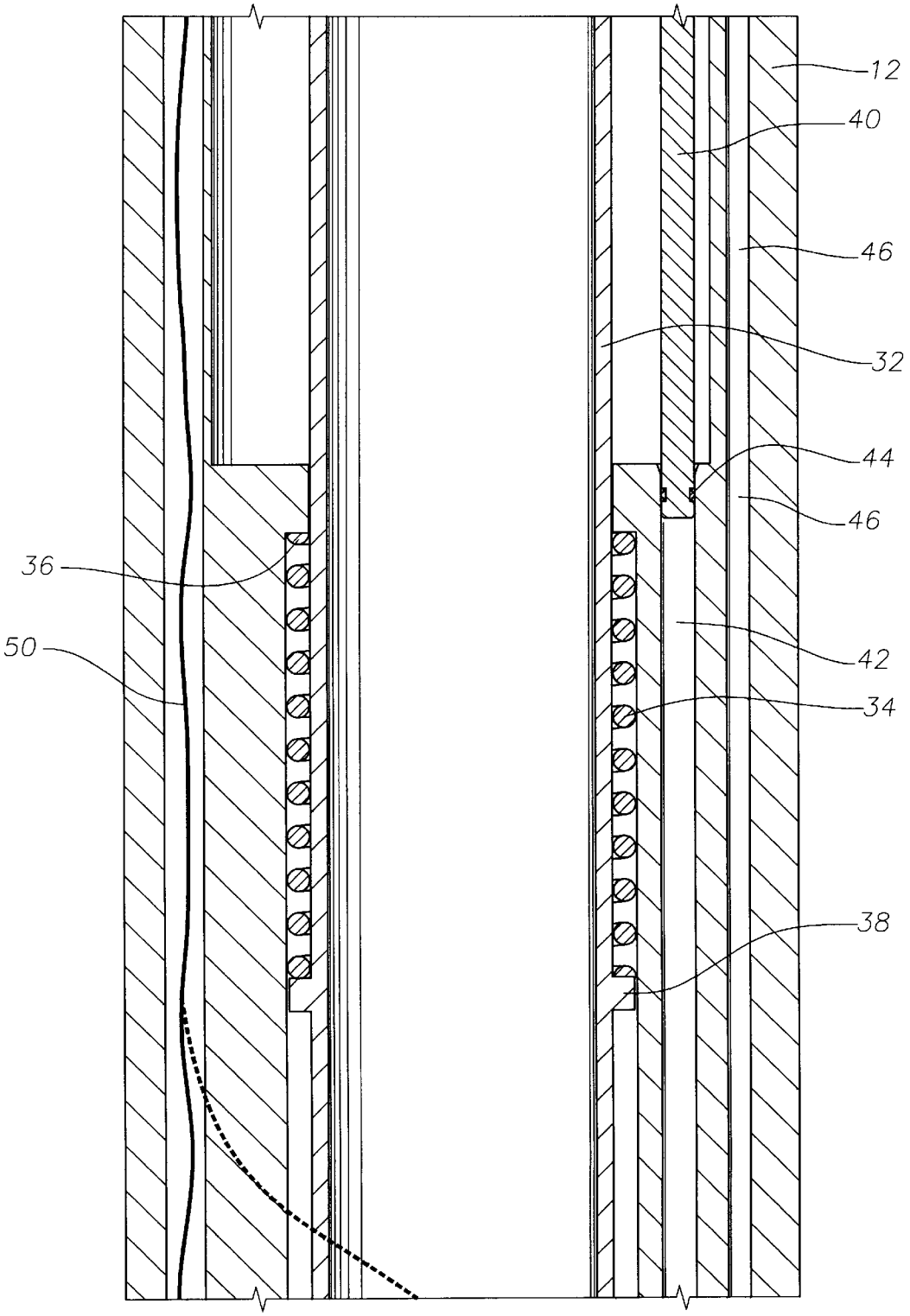
Figure 2D:
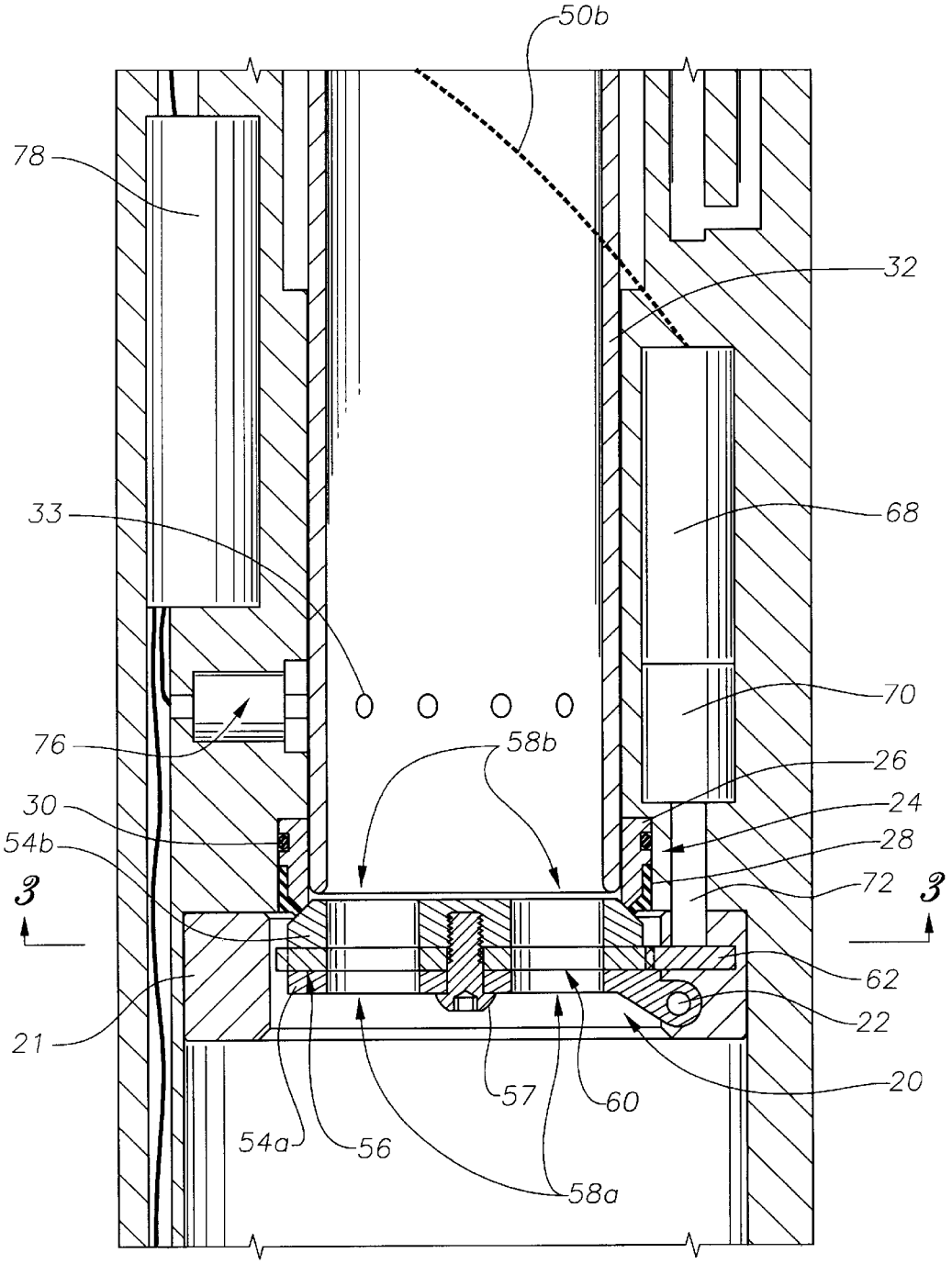
Figure 2E:
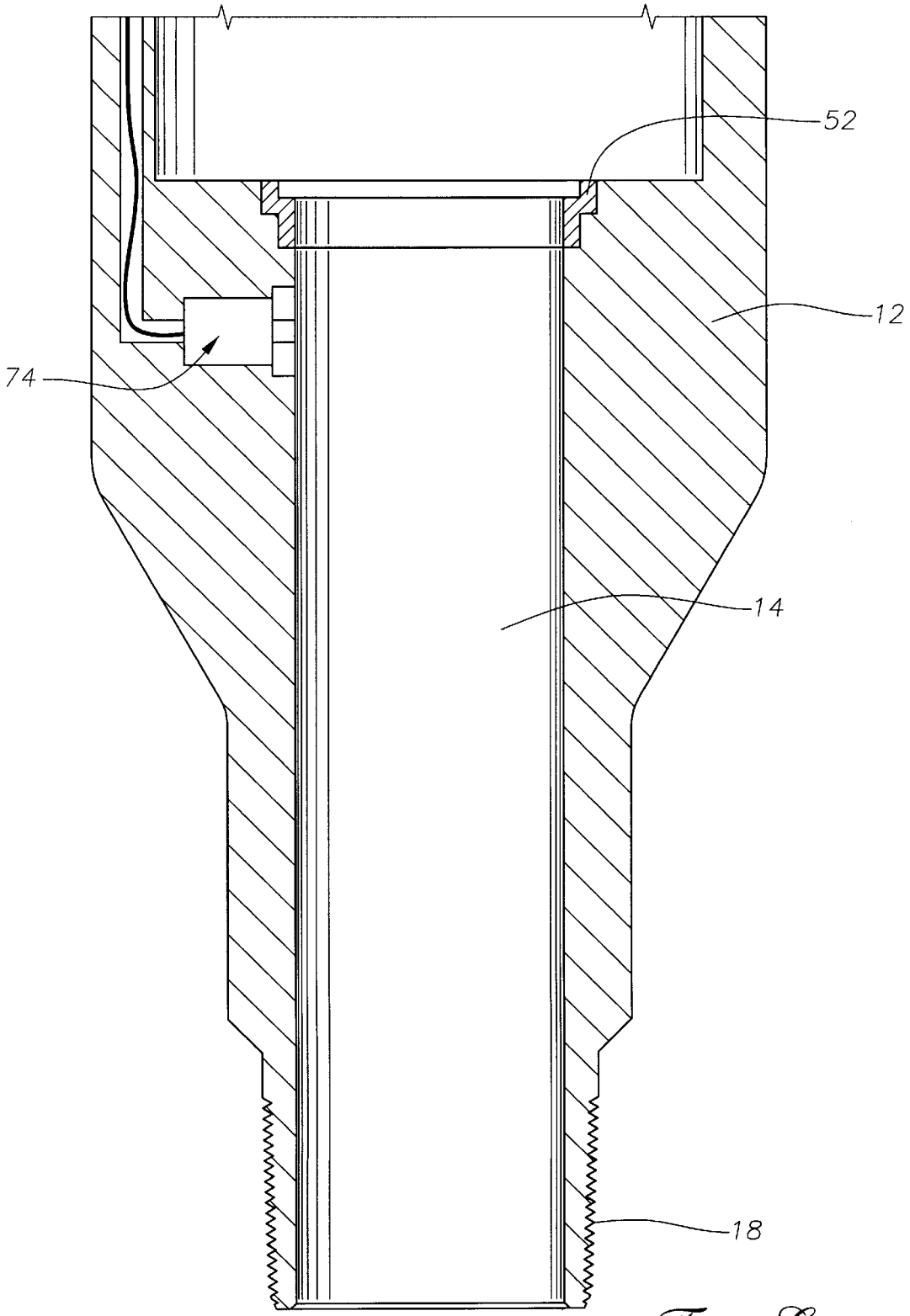

A valve element, such as flapper element 20, is provided, and is connected to a valve housing 21 on a pivot 22, and is movable from an open position to a closed position. Other types of valve elements, such as a gate valve, may be used in place of the flapper valve if desired. The valve housing 21 is secured to the inner wall of the housing 12 by conventional means, such as by welds. In the closed position, the valve 20 is seated on a valve seat 24, as shown in FIG. 2D, for restricting flow through the main bore 14. The valve seat 24 includes an annular metal valve member 26 for creating a primary seal and an annular plastic or elastomeric valve member 28 for creating a secondary seal when the valve 20 is in the closed position. An o-ring 30 seals the outer surface of the annular metal valve member 26 against the inner surface of the housing 12. A flow tube 32 is longitudinally movable in the housing 12 for controlling the opening and closing of the valve element 20. Biasing means, such as spring 34 acts between a shoulder 36 on the housing 12 and a shoulder 38 on the flow tube 32 to yieldably urge the flow tube 32 in a direction to engage and move the valve element 20 to an open position.

When the flow tube 32 is moved upwardly, the flapper valve 20 is freed for closure. A torsional spring element (not shown) acting on the flapper valve 20 forces the valve 20 to swing to the closed position such that the valve 20 engages the seat 24 and creates a seal. The flow tube 32 is moved upwardly, and closure of the flapper element 20 is obtained, by actuation of a hydraulic piston 40 which engages a second shoulder 39 on the flow tube 32. The hydraulic piston 40 is located in a cylinder 42 which is located in the housing 12, and has a longitudinal axis that is co-axial with the longitudinal axis of the housing 12. A piston seal means or ring 44 is provided in the outer annular surface of the piston 40 to provide a piston seal between the piston 40 and cylinder 42.

The piston 40, and consequently the flow tube 32 are moved along the longitudinal axis of the full bore variable flow control device 10 by application of hydraulic pressure through a hydraulic control line 46. Hydraulic fluid is pumped into and out of the cylinder 42 to cause movement of the piston 40 and flow tube 32 to control the opening and closing of the flapper valve 20. As shown in FIG. 2B, a motor/pump/fluid reservoir unit 48 is provided in the housing 12 of the flow control device 10 to supply hydraulic fluid to the cylinder 42 via control line 46. The motor/pump/fluid reservoir is preferably electrically controlled and monitored through a controller and monitor on the surface that is connected to the motor/pump/fluid reservoir by electric leads 50*a*. Alternatively, the motor/pump/reservoir unit, or component parts thereof, may be located at the surface and hydraulic fluid pumped from the surface to the piston and cylinder.

When the flapper valve 20 is in the open position, the flow tube 32 holds the flapper valve 20 in the open position. A lower edge of the flow tube 32 is seated in an annular seal 52, which is located on the inner surface of the housing 12 near the lower end thereof. When the lower edge of the flow tube engages the seal 52, production fluid is directed through the main bore 14 of the full bore variable flow control device 10. The seal 52 prevents leakage of production fluid into the area surrounding the retracted flapper valve 20 during full bore production.

When the flapper valve 20 is in the closed position, as shown in FIGS. 2A–2E, the valve seat 24 prevents production fluid from passing around the closed flapper valve 20. The flapper valve shown in FIGS. 2D & 3 generally comprises two parts: a main body member 54 comprising two halves 54*a* and 54*b*, and a rotating orifice plate 56 disposed between the two halves 54*a*, 54*b* of the main body member. The first half of the main body member 54*a*, the rotating orifice plate 56 and the second half of the main body member 54*b* are connected together by a pivot pin 57 such that the two halves of the main body member are fixed relative to one another and the rotating orifice plate 56 located between the two halves of the main body is rotatable in relation to the main body 54.

Figure 3:
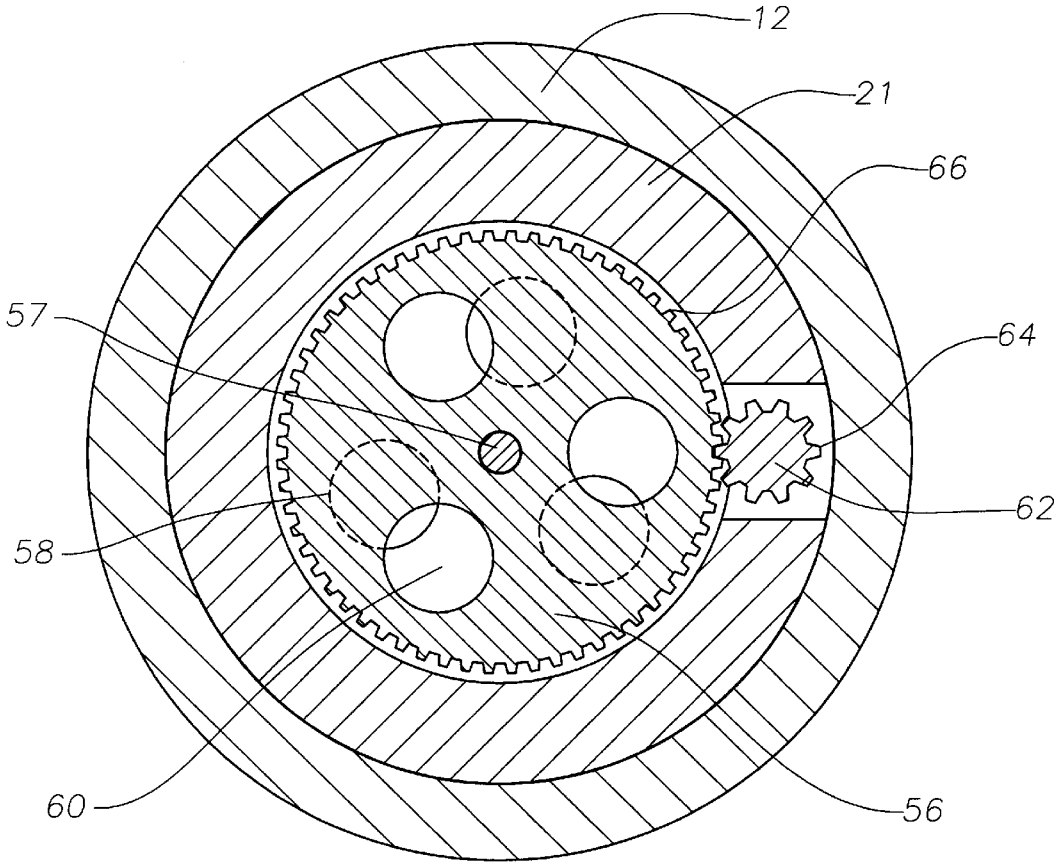
FIG. 3 is a cross-sectional view taken along the line A—A of FIG. 2D.

A plurality of flow control orifices 58 are provided in each of the two halves of the main body member 54. Preferably, as best shown in FIG. 3, each half of the main body member 54 is provided with three flow control orifices 58. The flow control orifices 58*a* located in the first half of the main body 54*a* are aligned with the flow control orifices 58*b* in the second half of the main body 54*b*. The rotating orifice plate 56 also exhibits a plurality of variable flow control orifices 60 located therein. As best shown in FIG. 3, three variable control orifices 60 are preferably provided.

With the flapper valve 20 in the closed position, as shown in FIG. 2D, flow through the main bore 14 of the variable flow control device 10 is controlled by rotation of the rotating orifice plate 56 to affect the alignment of the orifices 60 therein with the orifices 58 in the main body member 54. Rotary motion is preferably imparted to the rotating orifice plate 56 by a rotary gear 62 having teeth 64 which engage teeth 66 in the outer circumferential surface of the orifice plate 56. A motor 68, which is preferably located in the housing 12 of the flow control device 10, drives the gear 62. A gear box/brake 70 unit is connected to the motor 68 to transmit rotary motion to the gear 62 via drive shaft 72. Power is transmitted to the motor 68 from the surface through electrical leads 50*b*. A mechanism for determining the position of the rotating orifice plate, and therefore the degree of overlap between orifices in the main body member and orifices in the rotating plate is also provided. According to one preferred embodiment, the motor 68 is a stepper motor. Signals are generated by the stepper motor to indicate the amount of rotation thereof and are sent to the controller and monitor at the surface. Other devices for determining the position of a motor driven plate are well known and contemplated for use in connection with the present invention.

The rate at which product flows through the flow control device 10 can be measured both upstream and downstream of the variable flow control flapper valve 20 to allow operators to adjust the flow rate. An upstream pressure transducer sensor 74 is located along the inner wall of the housing 12 at a position upstream from the variable flow control flapper valve 20, while a second, downstream pressure transducer sensor 76 is located along the inner wall of the housing at a position downstream from the flapper valve 20. Openings 33 may be provided in the flow tube 32 to permit the upstream transducer 74 to communicate with fluid flowing through the bore. Alternatively, the flow tube 32 may be moved upwardly further in the bore to allow the transducer to freely communicate with fluid passing through the bore.

The upstream sensor 74 and downstream sensor 76 are both connected via electrical leads to a multiplexor 78 which is capable of simultaneously receiving signals from both transducer sensors over a common circuit and transmitting those signals to a controller at the surface via electrical leads 50. Alternatively, fiber optic leads may be used to connect a controller and monitor at the surface to the sensors 74, 76. Each of the transducers 74, 76 measures the pressure at that point in the tubing. From the difference in pressure between the two transducers, the flow rate can be calculated.

The transducers are preferably typical downhole devices such as quartz or sapphire piezoelectric crystals, true differential pressure devices, such as a bellow, or a stream gauge type device—i.e. a change in stress creates a current which is calibrated in pressure, temperature or differential pressure.

The terms "upstream" and "downstream" are relative to the direction of flow, and are not necessarily determinative of the physical positioning of the device. When the device is used as an element in a tubing string of a production well, the upstream pressure transducer sensor 74 is physically positioned below the downstream pressure transducer sensor 76 to measure the flow of product as it passes upwardly through the well to the surface. The device 10 may also be used as an element in a tubing string for an injection well to control the flow rate of the injection material. In an injection well, the flow control device 10 is inverted such that the upstream pressure transducer sensor 74 is physically positioned above the downstream pressure transducer sensor 76 to measure the flow of injection material as it passes downwardly into the well.

In operation, with the variable flow flapper valve 20 in the closed position, a pressure reading is taken at the upstream sensor 74 and is transmitted to the multiplexor 78. A pressure reading is also taken at the downstream sensor 76 and transmitted to the multiplexor 78. From these two signals, the multiplexor calculates the flow rate through the flow control device 10 and transmits a signal to the controller at the surface. If the operator wishes to adjust the flow rate, a signal from the controller is sent to the motor 68 to effect rotation of the rotating orifice plate 56. If the operator wishes to increase the flow rate, the orifice plate 56 is rotated to increase the overlap between the openings 60 in the orifice plate 56 and the openings 58 in the main body 54 of the flapper valve 20. Similarly, if the operator wished to decrease the flow rate, the orifice plate 56 is rotated to reduce the overlap between the openings 60 in the orifice plate 56 and the openings 58 in the main body 54 of the flapper valve 20.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A variable flow control device comprising:

a housing having a bore therethrough and adapted to be connected at each end thereof to well tubing;

a valve element connected to the housing and movable between an open position and a closed position in the bore;

one or more flow control orifices of variable size located in said valve element for controlling the flow of fluids through the bore of the housing when the valve element is in the closed position; and a drive mechanism connected to the valve element for controlling the size of said one or more flow control orifices.

2. The variable flow control device of claim 1, further comprising means for sensing the flow rate of fluid through the bore of the variable flow control device.

3. The variable flow control device of claim 2, wherein the flow rate sensing means comprises:

a first pressure transducer sensor positioned on an inner wall of the housing on a first side of the valve element;

a second pressure transducer sensor positioned on the inner wall of the housing on a second side of the valve element; and a multiplexor for receiving signals from each sensor and translating said signals into a flow rate signal.

4. The variable flow control device of claim 1 wherein the valve element comprises a main body member and an orifice plate rotatable in relation to said main body member.

5. The variable flow control device of claim 4, wherein one or more flow control orifices are formed in the orifice plate and one or more corresponding flow control orifices are formed in the main body member.

6. The variable flow control device of claim 5, further comprising a drive mechanism for imparting rotary motion to the orifice plate.

7. The variable flow control device of claim 6, wherein the drive mechanism comprises:

a gear engaging the outer circumferential surface of the orifice plate to impart rotary motion thereto;

a drive shaft coupled to the gear; and a motor coupled to the drive shaft for imparting rotary motion to the gear.

8. The variable flow control device of claim 1, further comprising:

a flow tube longitudinally movable in the housing for causing the opening and closing of the valve element;

spring means positioned between the housing and the flow tube for moving the flow tube in a direction to open the valve element; and a hydraulic piston and cylinder assembly located in the housing, the piston connected to the flow tube for moving the flow tube in a direction to close the valve element.

9. The variable flow control device of claim 1 further comprising a valve seat element for receiving the valve element in the closed position.

10. A variable flow control device comprising:

a housing having a bore therethrough and adapted to be connected at each end thereof to well tubing;

a valve element connected to the housing and movable between an open position and a closed position in the bore, the valve element comprising a body member having at least one flow control orifice therethrough and a rotating orifice plate having at least one flow control orifice therethrough; and means for controlling the flow of fluids through the housing when the valve element is in the closed position, said means comprising drive means for rotating the orifice plate relative to the body member and thereby controlling the alignment between the at least one flow control orifice in the body member and the at least one flow control orifice in the orifice plate.

11. The variable flow control device of claim 10, further comprising means for sensing the flow rate of fluid through the bore of the housing of the variable flow control device.

12. The variable flow control device of claim 10, further comprising means for opening and closing the valve element.

13. The variable flow control device of claim 10, wherein the valve element comprises two body member halves that are located on either side of the orifice plate, wherein the orifice plate and both halves of the body member each have at least one flow control orifice therethrough.

14. A variable flow control device comprising:

a housing having a longitudinal bore therethrough and adapted to be connected at each end thereof to well tubing;

a flapper valve element connected to the housing and movable between an open position and a closed position in the bore, the flapper valve element comprising a body member and an orifice plate that is rotatable relative to the body member, the body member and the orifice plate each comprising a plurality of flow control orifices therethrough, wherein the alignment of the flow control orifices in the body member with the flow control orifices in the orifice plate is controllable by the relative rotational position of the body member and the orifice plate; and a drive mechanism connected to the orifice plate for rotating the orifice plate relative to the body member and thereby controlling fluid flow through the flow control orifices.

* * * * *